US008888668B2

(12) United States Patent
Delisle

(10) Patent No.: US 8,888,668 B2
(45) Date of Patent: Nov. 18, 2014

(54) EXERCISE APPARATUS FOR ACCOMMODATING PUSH-UPS

(76) Inventor: Daniel Allen Delisle, Washington, DC (US)

( * ) Notice: Subject to any disclaimer, the term of this patent is extended or adjusted under 35 U.S.C. 154(b) by 189 days.

(21) Appl. No.: 13/374,946

(22) Filed: Jan. 24, 2012

(65) Prior Publication Data

US 2013/0190150 A1 Jul. 25, 2013

(51) Int. Cl.

| | |
|---|---|
| ***A63B 71/00*** | (2006.01) |
| ***A63B 21/00*** | (2006.01) |
| ***A63B 23/14*** | (2006.01) |
| ***A63B 21/075*** | (2006.01) |
| ***A63B 23/16*** | (2006.01) |
| ***A63B 23/12*** | (2006.01) |

(52) U.S. Cl.

CPC ..... *A63B 23/1236* (2013.01); *A63B 21/075* (2013.01)

USPC ..... 482/141; 482/45; 482/131; 482/108; 482/50

(58) Field of Classification Search

CPC ..... A63B 21/004; A63B 21/00185; A63B 21/068; A63B 22/0007; A63B 22/203; A63B 22/18; A63B 22/20; A63B 23/02; A63B 23/0211; A63B 23/1209; A63B 23/1236

USPC ..... 482/44, 50, 49, 141, 132, 146

See application file for complete search history.

(56) References Cited

U.S. PATENT DOCUMENTS

| | | | | |
|---|---|---|---|---|
| 3,115,338 | A | 12/1963 | Acs et al. | |
| 4,351,525 | A | 9/1982 | Rozenblad | |
| 4,610,448 | A | 9/1986 | Hill | |
| 4,770,409 | A | 9/1988 | Wallisch | |
| 5,358,463 | A | 10/1994 | Fuentes | |
| 5,496,244 | A * | 3/1996 | Caruthers | 482/108 |
| 6,551,225 | B1 * | 4/2003 | Romero | 482/146 |
| D479,289 | S | 9/2003 | Turner | |
| D576,693 | S | 9/2008 | Khubani | |
| 7,468,025 | B2 | 12/2008 | Hauser et al. | |
| 7,481,753 | B2 | 1/2009 | James et al. | |
| D585,947 | S | 2/2009 | Royster | |
| 7,553,267 | B1 | 6/2009 | Hauser et al. | |
| D597,153 | S | 7/2009 | Friedman et al. | |
| 7,585,262 | B1 | 9/2009 | Vayntraub | |

(Continued)

OTHER PUBLICATIONS

U.S. Appl. No. 13/441,886, filed Oct. 11, 2012, Anthony Dean Lafferty.

*Primary Examiner* — Loan H Thanh
*Assistant Examiner* — Sundhara Ganesan
(74) *Attorney, Agent, or Firm* — James M Smedley LLC; James M. Smedley, Esq.; Joseph Parish Esq.

(57) ABSTRACT

The present invention provides for an exercise apparatus for assisting in performing a push-up exercise. The apparatus includes a base with a convex outer surface connected to the handle support structure and a handle. The convex outer surface of the base of the apparatus provides a user with a means to engage muscle groups not normally exercised during a conventional push-up exercise, through the action of continuously stabilizing their weight on the apparatus, and by providing a means to rotate the wrists during the exercise. The apparatus also provides a user with a means to perform the exercise at different widths and positions during the exercise, by repositioning (sliding or moving) the apparatus during the exercise, on an appropriate surface. The apparatus is also intended to be lightweight and compact enough to be transportable for activities such as jogging or running.

21 Claims, 12 Drawing Sheets

(56) References Cited

U.S. PATENT DOCUMENTS

| | | | | |
|---|---|---|---|---|
| 7,621,858 | B2 * | 11/2009 | Sheron | 482/132 |
| 7,658,700 | B2 * | 2/2010 | Maloy et al. | 482/132 |
| D631,106 | S * | 1/2011 | Zemel | D21/662 |
| 7,896,789 | B2 | 3/2011 | Hinton et al. | |
| 7,935,040 | B2 | 5/2011 | Moskowich | |
| 7,951,055 | B2 | 5/2011 | Mulderrig et al. | |
| 8,105,218 | B1 * | 1/2012 | Vayntraub | 482/141 |
| 8,353,808 | B1 * | 1/2013 | Barney | 482/132 |
| 8,480,547 | B2 * | 7/2013 | Coates | 482/92 |
| 2005/0209072 | A1 * | 9/2005 | Sheron | 482/132 |
| 2007/0287605 | A1 * | 12/2007 | Mylrea et al. | 482/92 |
| 2007/0298947 | A1 * | 12/2007 | Eksteen | 482/141 |
| 2008/0039304 | A1 * | 2/2008 | Mattox | 482/130 |
| 2010/0261590 | A1 * | 10/2010 | Fares | 482/131 |
| 2010/0279833 | A1 * | 11/2010 | Gant | 482/141 |
| 2010/0317496 | A1 * | 12/2010 | Abranchess | 482/141 |
| 2011/0143896 | A1 * | 6/2011 | Senegal | 482/139 |
| 2011/0160024 | A1 * | 6/2011 | Candela et al. | 482/132 |
| 2012/0010058 | A1 * | 1/2012 | Sprague | 482/141 |

* cited by examiner

EXERCISE APPARATUS FOR ACCOMMODATING PUSH-UPS

FIELD OF THE INVENTION

The present invention is in the field of sporting goods and pertains more particularly to exercise equipment related to calisthenic exercises (e.g., push-up, pull-up, sit-up exercises that use the body's weight for resistance, or else minimal supplementary weights) to provide a user with improved results during exercise training—when strengthening and conditioning upper body, core, and lower body muscles, which can benefit both muscular and cardiovascular fitness, in addition to improving psychomotor skills such as dexterity, speed, balance, agility, and coordination, as well as improve flexibility.

BACKGROUND

A conventional push-up is one of the most basic exercises performed in individual strength and exercise training. A push-up is the process of allowing gravity to provide resistance upon the body during the action of lowering and pushing the body, towards and away, respectively, from the floor or other contact surface through a range of motion using the muscles of the hands, arms, and other muscles of the body.

A conventional push-up exercise is typically performed with bare hands on the ground, underneath the shoulders or chest, with the hands forming a fixed angle (approximately 90 degrees) with the forearms, and toes/feet in contact with the same surface as the hands. The conventional push-up exercise is then executed, in this fashion, by lowering and raising the body by bending the arms at the elbows, while generally keeping the toes/feet fixed in the same location.

SUMMARY OF THE INVENTION

Typically, the wrists remain static, or stationary, and at the same fixed angle during the conventional push-up exercise, and the body is lowered to approximately the same elevation of the surface where the hands are placed. Fundamentally, lowering and raising the body, along with the resistance provided by gravity, provides exercise training (e.g., build strength, endurance, and flexibility, as defined above).

There are several limitations with conventional push-up exercises, such as joint and/or muscle stress from the wrist position. For some, the conventional push-up exercise can cause pain and/or discomforts in the wrists from the extreme load and/or stress on the muscles and joints, due to hyperextending (extending beyond natural flexure) the hands, wrists, and/or forearm muscles and joints when forming the fixed angle with respect to the forearms. These pains and/or discomforts can discourage a person from performing a conventional push-up exercise, or at least, with proper technique.

Another limitation with the conventional push-up exercise is the lack of eccentric forces (i.e., off-center forces that do not pass through the center of gravity of the body on which it acts) utilized during the exercise. The conventional push-up exercise does not necessarily use all of the muscles in the upper body; since the conventional push-up exercise is performed with a locked wrist with a fixed angle on a surface where the hands and wrists are relatively stable, only a fraction of the muscles are used in order to lower and raise the body during the exercise. Using weighted dumbbells in lieu of a bar during a workout can increase the amount of muscles used because muscles must react to the eccentric forces to keep the dumbbells in the direction and extension intended.

Allowing for eccentricities can introduce forces that the body can react to and therefore provide additional exercise training.

Another limitation is the lack of rotation of the wrists and forearms. In the exercise community, it is commonplace to use free-weights (such as dumbbells) and/or cable-weights during a workout that do not restrict the hands, wrists, and forearms to naturally rotate when extended away from the body. Likewise, in the martial arts community, it is customary to naturally rotate the hands, wrists, and forearms when throwing punches. The conventional push-up exercise prevents the natural rotation of muscles and joints because the hands are fixed to the surface being used to perform the exercise.

Another limitation is the limited range of motion when lowering and raising the body. The conventional push-up exercise prevents the capability for lowering the body farther than the surface in contact with the hands when performing the push-up exercise. Limiting the range of motion of an exercise can prohibit flexibility and prevent full engagement of muscles. Allowing for increased range of motion can promote several benefits for exercise training, including greater engagement of the muscles and improved flexibility.

Another limitation is the limited range of motion of hands and arms on the plane of the surface in contact with the hands. The conventional push-up exercise requires the hands to remain fixed in the same location when pressure or force is applied to the surface being used to perform the exercise. The ability to move or slide the hands during the push-up exercise can provide additional beneficial exercise training by providing additional range of motion. For example, some training exercises require one hand to remain fixed on a surface, while allowing the other hand freedom to move or slide (e.g., on an object, such as a dinner plate that can move or slide over a surface while maintaining smooth continuous contact). During the lowering and raising motions, the hand that is not fixed can move or slide laterally away from and towards the body, during the raising and lowering motion of the exercise. Another example of a training exercise requires both arms and hands to extend away from the front of the body while lowering the body, and drawing the hands towards the body while raising the body, thus providing concentrated abdominal training and resistance. This additional range of motion further stimulates and concentrates on additional groups of muscles in the body (e.g., arms, shoulders, back muscles, abdominals, etc.) and increases flexibility.

Some current art push-up devices with rotation features possess the shortcoming that they are stable when used on a surface, and the user is not required to stabilize the device with muscles that are not otherwise exercised (i.e., these devises do not allow for eccentricities and prevent targeting muscles that the body can react to and therefore build strength and/or endurance).

Some current prior art push-up devices with rotation features or instability are cumbersome and heavy, or contain several components and moving parts (e.g., ball-bearings), and cannot be moved, slid, or repositioned during a push-up exercise; these devices are also not meant to be transportable for combining with activities such as jogging or running.

Therefore, there is a need for an apparatus that provides natural rotation of the hands, wrists, and forearms, while also providing a means to limit stresses in the wrist due to hypertension, improves range of motion for depth of lowering the body, allows a user to move the apparatus under the body during an exercise, and is lightweight and compact enough to be transportable for exercise activities such as jogging or running.

The present invention aims to provide an apparatus to modify the conventional push-up exercise and provide a solution the above-listed and other problems.

It is an object of the present invention to reduce the load or stress upon the wrists and/or forearms by providing a handle or grasp section that can be gripped with the hands to provide the means to reduce stress due to the extreme angle of the hands and wrist to the forearm during a conventional push-up. The present invention enables the engagement the muscles, without undue stress from the wrist position.

It is an object of the present invention to reduce the load or stress upon the wrists and/or forearms by providing a handle or grasp section, but still providing exercise for the wrist through eccentric and reaction forces. The present invention enables the engagement the wrist muscles, without undue stress from hyperextension, by allowing the wrists and other muscles of the body to react to eccentric forces to keep the body balanced in position throughout a push-up exercise, thereby exercising and strengthening muscles because they are constantly balancing the body on the apparatus.

It is an object of the present invention to enable the rotation of the hands, wrists, and forearms, by rotation of the elbow(s) (turning the elbow(s) away from, and towards the body) throughout the push-up exercise. This rotation, in turn, allows for natural rotation of the hands, wrists, and forearms, and accesses and targets more muscles. The present invention allows the body to access and target a larger number of muscles than when performing a conventional push-up.

It is an object of the present invention to allow a user to increase their range of motion (i.e., ability to lower the body into a lower position in relation to the elevation of the hands) when performing the push-up exercise. By increasing the range of motion throughout the exercise, flexibility is increased, hence enhancing the exercises, and engage more muscle groups. The present invention allows the body to access and target a larger number of muscles than when performing a conventional push-up.

It is an object of the present invention to allow the increase of the range of motion by moving or sliding the apparatus when performing the push-up exercise or other exercises. By increasing the range of motion throughout the exercise, the body can become more flexible, hence enhancing the exercises, engaging more muscle groups, and therefore exercising and strengthening more muscle groups. The present invention provides the ability to move or slide the hands during the push-up exercise and, therefore, supplies additional beneficial exercise training by providing additional range of motion.

It is an object of the present invention to enable a user to yield improved results with respect to the exercise of muscles; by stimulating a larger range of muscles during the push-up exercise, muscles will be exercised more efficiently and effectively, thereby increasing muscle performance.

According to one embodiment of the present invention, an exercise apparatus comprises a base having a convex outer surface, constructed to allow limited contact with a contact surface; a handle having a grasp section adapted to be gripped by human hands; and an extension member connecting at least one end of the handle to the base and configured to support the handle at an extended position relative to the base and above the contact surface.

In one aspect of the present invention, the exercise apparatus the base of the exercise comprises a concave inner surface. In one aspect of the present invention, the exercise apparatus comprises a convex outer surface that is smooth and provides minimal friction, allowing the ability to slide or move the apparatus when in contact with another surface. In one aspect of the present invention, the exercise apparatus comprises a convex outer surface that is rough and provides considerable friction, disallowing sliding or moving the apparatus when in contact with another surface. In one aspect of the present invention, the exercise apparatus comprises a handle that is integrally formed with the extension member. In one aspect of the present invention, the exercise apparatus comprises a handle that is mechanically fastened to the extension member. In one aspect of the present invention, the exercise apparatus comprises a grasp section comprises ridges for human fingers. In one aspect of the present invention, the exercise apparatus comprises grasp section may be ergonomically shaped, such as curved, profiled, or contoured. In one aspect of the present invention, the exercise apparatus comprises the grasp section comprises a rough surface to increase contact friction for the human hand. In one aspect of the present invention, the exercise apparatus comprises the grasp section comprises a squeezable grip to provide exercise for the wrist, hand, and forearm muscles for the human hand. In one aspect of the present invention, the exercise apparatus comprises the grasp section comprises a compressible material to reduce point-load pressure for the human hand. In one aspect of the present invention, the handle and the extension member of the exercise apparatus comprises a removable fastener, hinge, or removable parts, and is adapted to be removable. In one aspect of the present invention, the handle and the extension member of the exercise apparatus comprises a removable fastener, hinge, or removable parts, and is adapted to be collapsible. In one aspect of the present invention, the material used for the base of the exercise apparatus comprises a range of weights to provide additional strength training during an exercise; the weight of the base may be between 0.25 lbs and 25 lbs. In one aspect of the present invention, the material used for the handle or grasp section of the push-up exercise apparatus comprises a range of weights to provide additional strength training during an exercise; the weight of the base may be between 0.25 lbs and 25 lbs.

In one aspect of the present invention, the base of the exercise apparatus is adapted to have a replaceable outer surface that is detachably connected to the base configured to be mechanically attached to the convex outer surface of the base. In one aspect of the present invention, the base of the exercise apparatus is adapted to have a replaceable outer surface that is detachably connected to the base configured to be adhered to the convex outer surface of the base. In one aspect of the present invention, the base of the exercise apparatus is adapted to have a replaceable outer surface that is detachably connected to the base and comprises a range of weights to provide additional strength training during an exercise. In one aspect of the present invention, the convex outer surface of the base contains additional material having a radius of curvature less than a radius of curvature of the convex outer surface, configured to provide further instability during a push-up exercise. In one aspect of the present invention, the convex outer surface of the base contains additional material comprising a ring of material and protruding from the base, with purpose of providing a means to preventing further instability once a certain threshold of instability is reached. In one aspect of the present invention, the base comprises extension members configured to connect to a pull-up apparatus for other exercises.

According to one embodiment of the present invention, the exercise apparatus comprises a method of performing an exercise, including pressing the convex outer surface of the base against the contact surface while grasping the handles and continuously stabilizing the apparatus through eccentric and reaction forces. According to one embodiment of the present invention, the exercise apparatus comprises a method of performing an exercise, including sliding, moving, or repositioning the apparatus during the exercise.

In one aspect of the present invention, the method of performing an exercise further comprises using the pushup apparatus on a mat that allows for sliding or moving the apparatus during a pushup. In one aspect of the present invention, the method of performing an exercise further comprises using the push-up apparatus on a mat that is padded to allow for cushioning during exercises. In one aspect of the present invention, the method of performing an exercise further comprises using the push-up apparatus on a mat that can be rolled for storage. In one aspect of the present invention, the exercise apparatus comprises compact shape and materials that are not cumbersome for transporting the apparatus and combining the push-up exercise with running. In one aspect of the present invention, the method of performing an exercise further comprises pressing the convex outer surface against the contact surface to provide a contact area of between approximately ⅛ square inch and 1 square inch. In one aspect of the present invention, the convex outer surface has a radius of curvature of between approximately 0.5 inches and 12 inches. In one aspect of the present invention, the base along the same axis as the handle or grasp section has a dimension (or diameter, is base is circular) of between approximately 4 inches and 6.5 inches. In one aspect of the present invention, the base along the axis perpendicular to the handle or grasp section has a dimension (or diameter, is base is circular) of between approximately 2 inches and 6.5 inches. In one aspect of the present invention, the base has a thickness of between approximately ¼ inches and 1 inch. In one aspect of the present invention, the base has a cross sectional shape having two substantially parallel sides and two rounded edges.

The above-listed and other features of the present invention will be further described in greater detail in the following specification and drawings.

DETAILED DESCRIPTION OF EMBODIMENTS

According to a preferred embodiment of the present invention, a push-up exercise apparatus 101 is used for enabling one to strengthen their muscles and increase flexibility with an improved push-up exercise.

Figure 1:
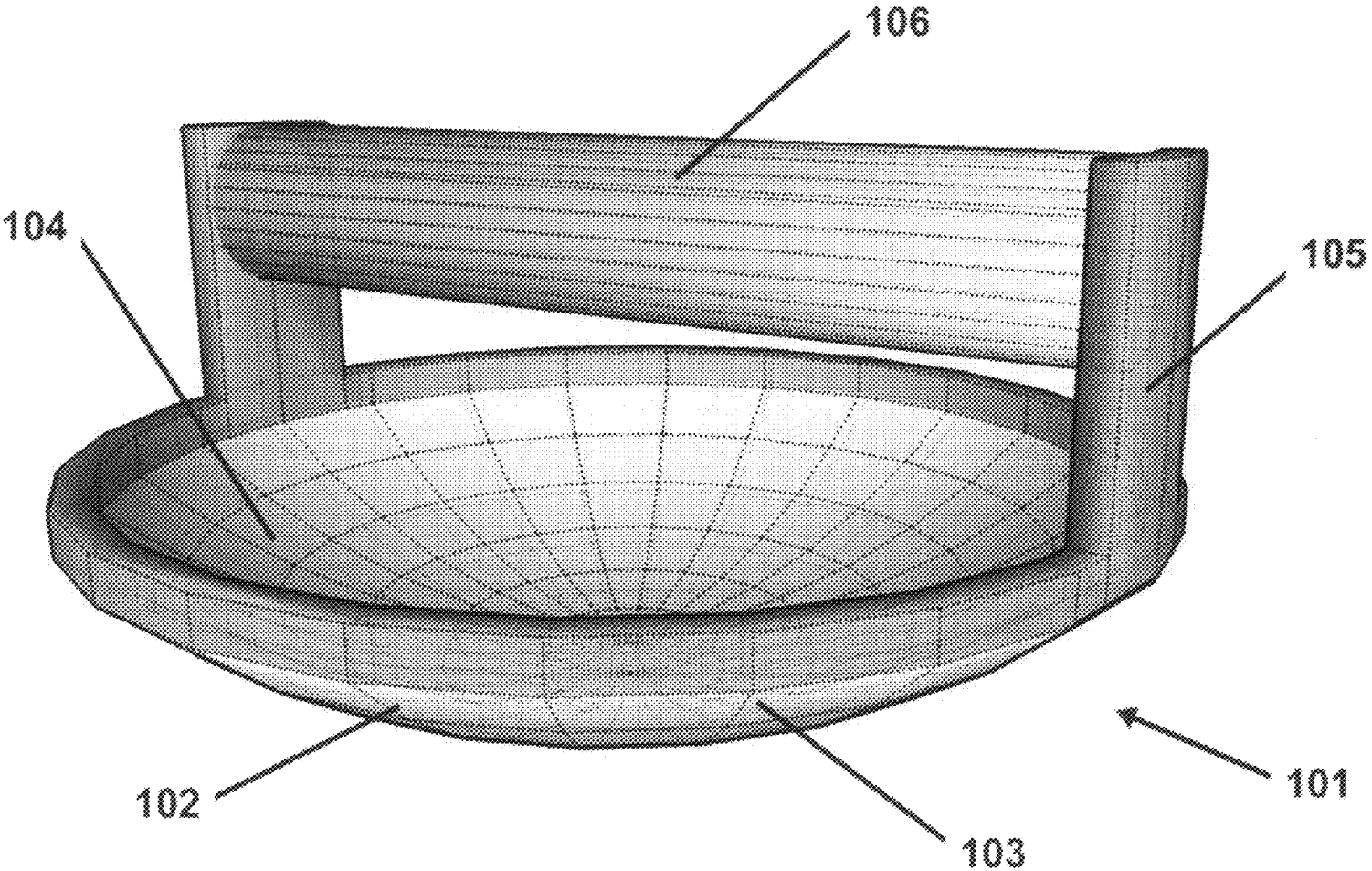
FIG. 1 shows a perspective view of an exercise apparatus according to one embodiment of the present invention.

As depicted in FIG. 1, the improved push-up exercise apparatus 101 comprises a base 102 having a rounded or substantially convex outer surface 103 formed to allow limited contact with the floor or other contact surfaces, a rounded or substantially concave inner surface 104 formed to provide space for hands and allow for efficient, compact design using minimal materials, and an extension member 105 connected to the base 102 to support a handle or grasp section 106 at an elevated position relative to the base 102.

Figure 2A:
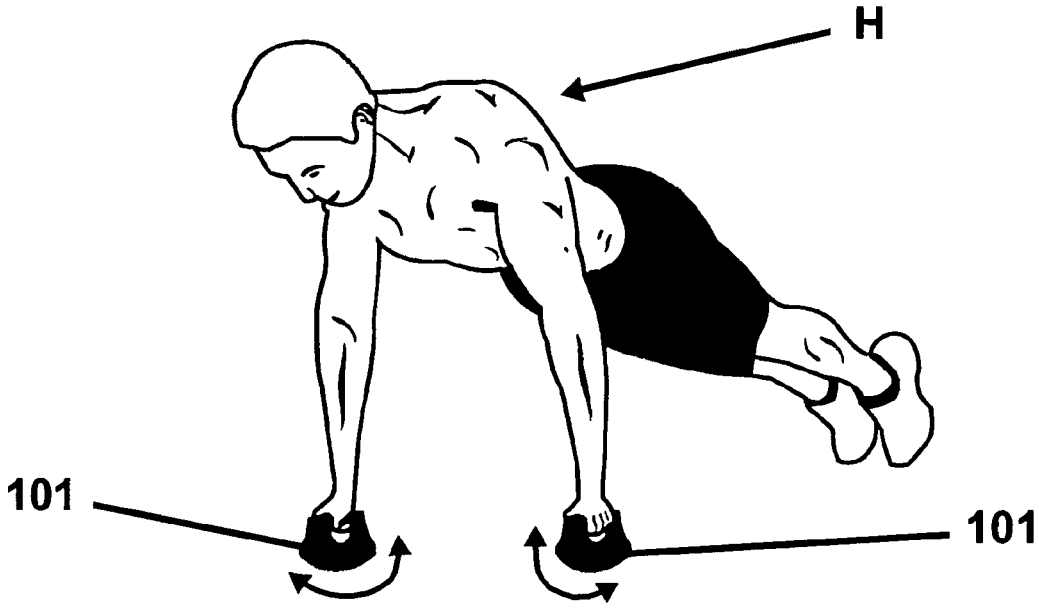
FIG. 2A shows a perspective view of a human using the exercise apparatus according to one embodiment of the present invention.
Figure 2B:
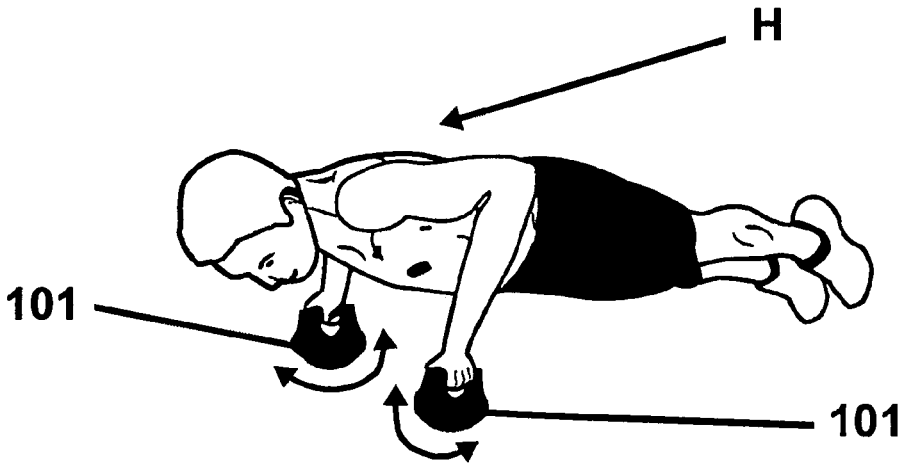
FIG. 2B shows a perspective view of a human using the exercise apparatus according to one embodiment of the present invention.

As depicted in FIG. 2A and FIG. 2B, the push-up exercise apparatus 101 is used to perform a push-up exercise by lowering and raising the body of a human H, along with the resistance provided by gravity, to provide exercise training (e.g., build strength, endurance, and flexibility, as described above). FIG. 2A shows a human H in the raised position of the push-up exercise, with arms fully extended from the body and grasping the handle or grasp section 106 (shown in FIG. 1) of the push-up exercise apparatus 101 placed underneath the shoulders or chest. FIG. 2B shows a human H in the lowered position of the push-up exercise, after lowering the body by bending the arms at the elbows while grasping the handle or grasp section 106 (shown in FIG. 1) of the push-up exercise apparatus 101, while rotating the forearms, wrists, and hands with the natural motion described above.

Figure 3A:
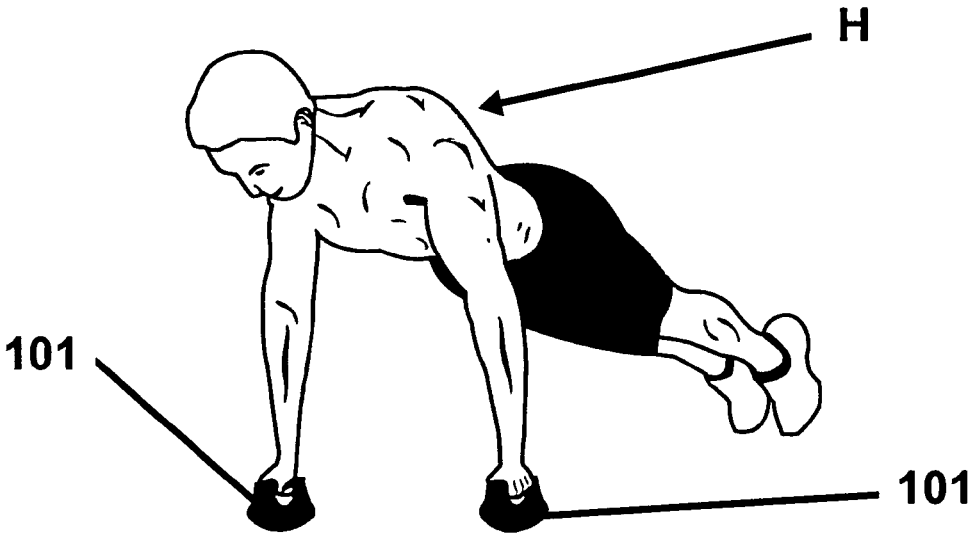
FIG. 3A shows a perspective view of a human using an exercise apparatus according to another embodiment of the present invention.
Figure 3B:
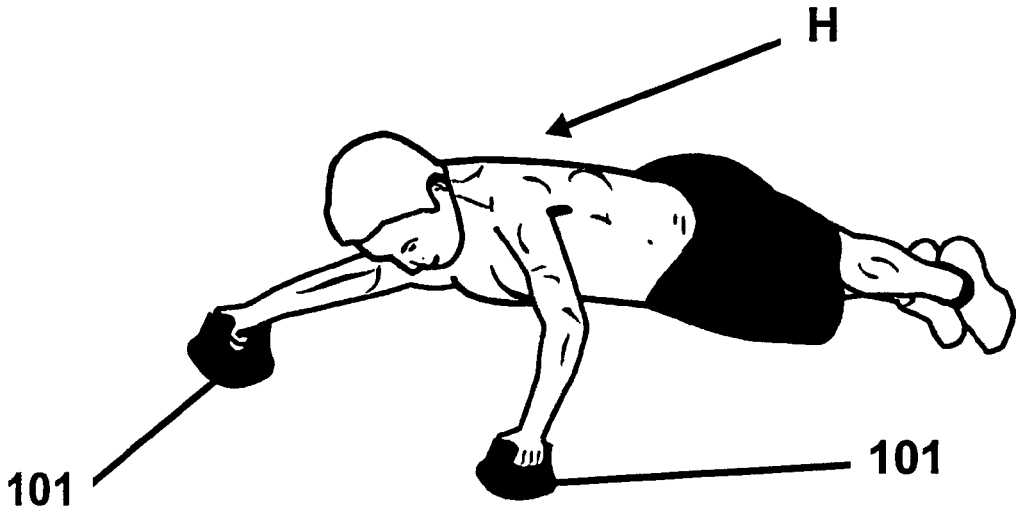
FIG. 3B shows a perspective view of a human using an exercise apparatus according to another embodiment of the present invention.

As depicted in FIG. 3A and FIG. 3B, the push-up exercise apparatus 101 is used to perform a modified push-up exercise by lowering and raising the body of a human H, leaving one fixed (only rotating in place), while simultaneously allowing the hand that is not fixed to move or slide laterally away from and towards the body of the human H, along with the resistance provided by gravity, to provide exercise training. FIG. 3A shows a human H in the raised position of the modified push-up exercise, with arms fully extended from the body and grasping the handle or grasp section 106 (shown in FIG. 1) of the push-up exercise apparatus 101 placed underneath the shoulders or chest. FIG. 3B shows a human H in the lowered position of the modified push-up exercise, after lowering the body by bending one of the arms at the elbows while grasping the handle or grasp section 106 (shown in FIG. 1) of the push-up exercise apparatus 101, while rotating the forearms, wrists, and hands with the natural motion described above, and sliding the push-up exercise apparatus 101 away from the body during the lowering and raising motions of the push-up exercise.

Figure 4A:
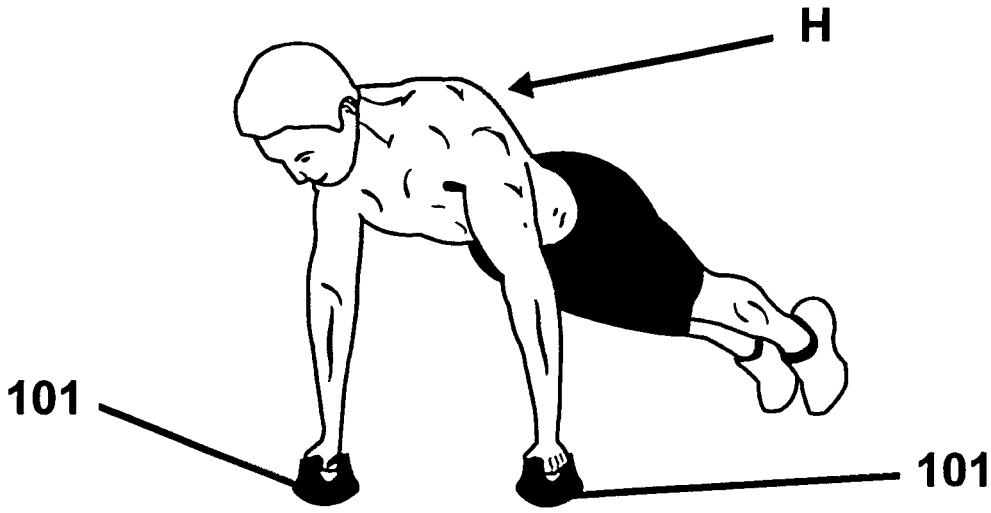
FIG. 4A shows a perspective view of a human using an exercise apparatus according to another embodiment of the present invention.
Figure 4B:
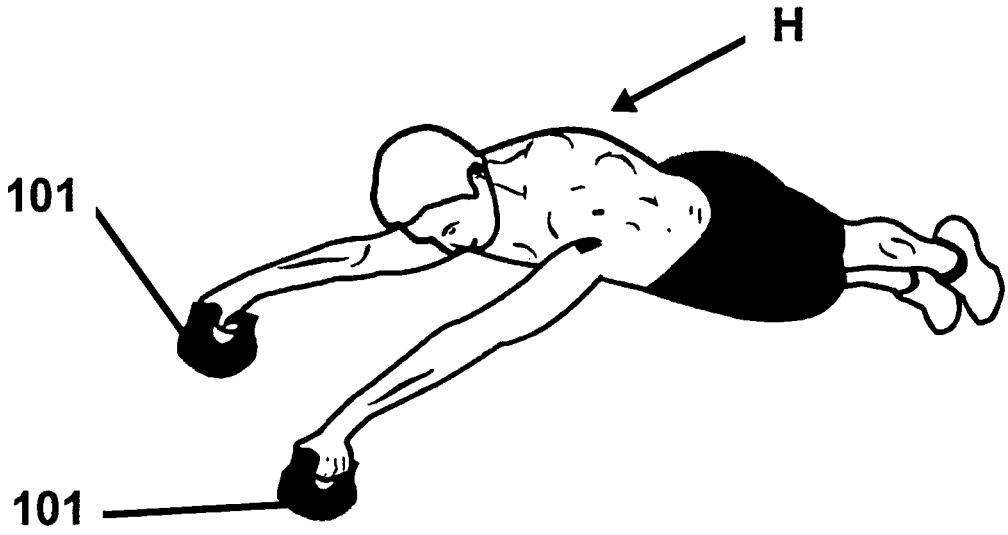
FIG. 4B shows a perspective view of a human using an exercise apparatus according to another embodiment of the present invention.

As depicted in FIG. 4A and FIG. 4B, the push-up exercise apparatus 101 is used to perform a modified abdominal exercise by lowering and raising the body, along with the resistance provided by gravity, to provide exercise training. FIG.

4A shows a human H in the raised position of the abdominal exercise, with arms fully extended from the body and grasping the handle or grasp section 106 (shown in FIG. 1) of the push-up exercise apparatus 101 placed underneath the shoulders or chest. Note that the toes/feet can be in contact with the ground or the knees can be on the ground for this abdominal exercise. FIG. 4B shows a human H in the lowered position of the abdominal exercise, after lowering the body by grasping the handle or grasp section 106 (shown in FIG. 1) of the push-up exercise apparatus 101, and sliding the push-up exercise apparatus 101 forward and away from the body during the lowering and towards the body during the raising motions of the abdominal exercise.

Figure 5:
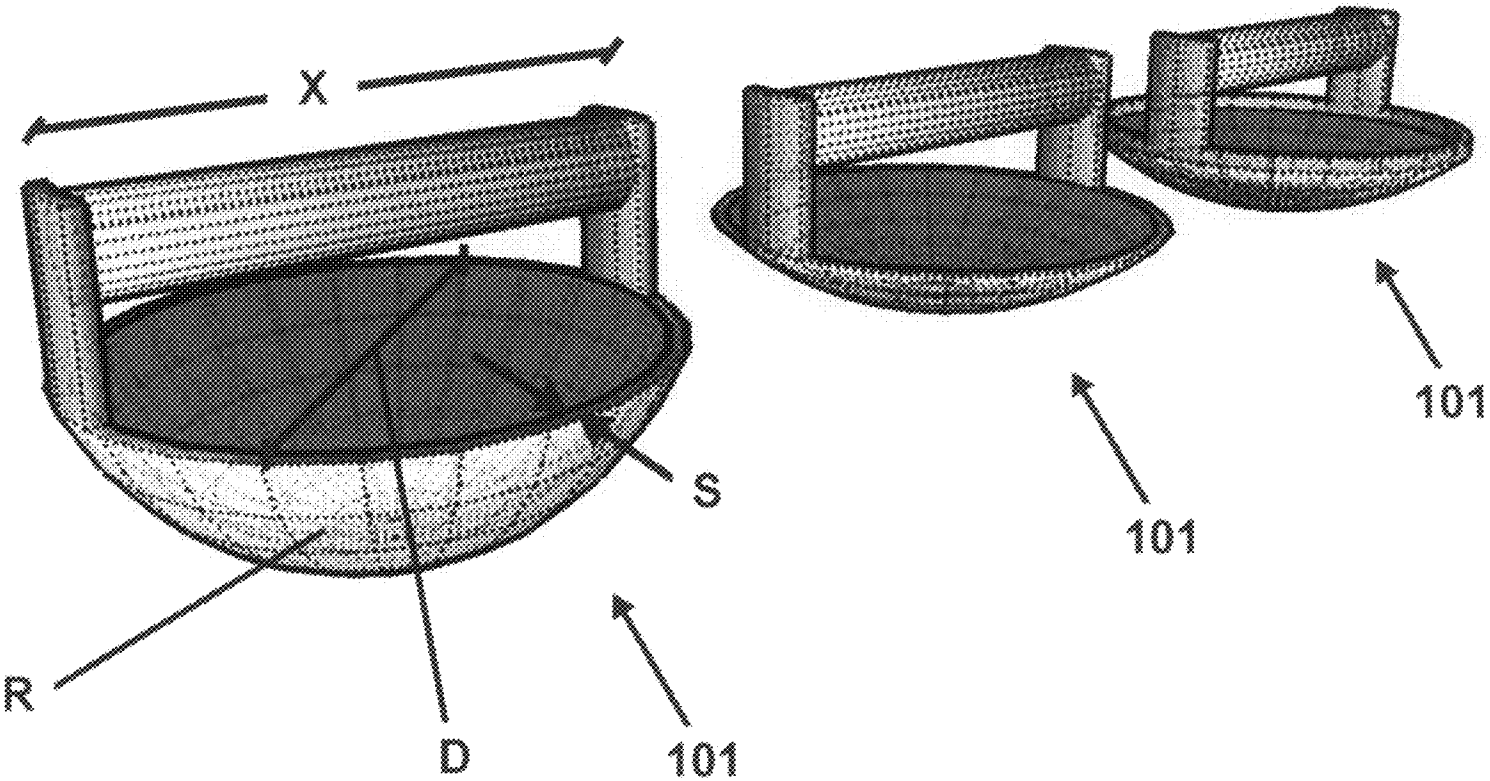
FIG. 5 shows a perspective view of several exercise apparatuses according to an embodiment of the present invention.
Figure 10:
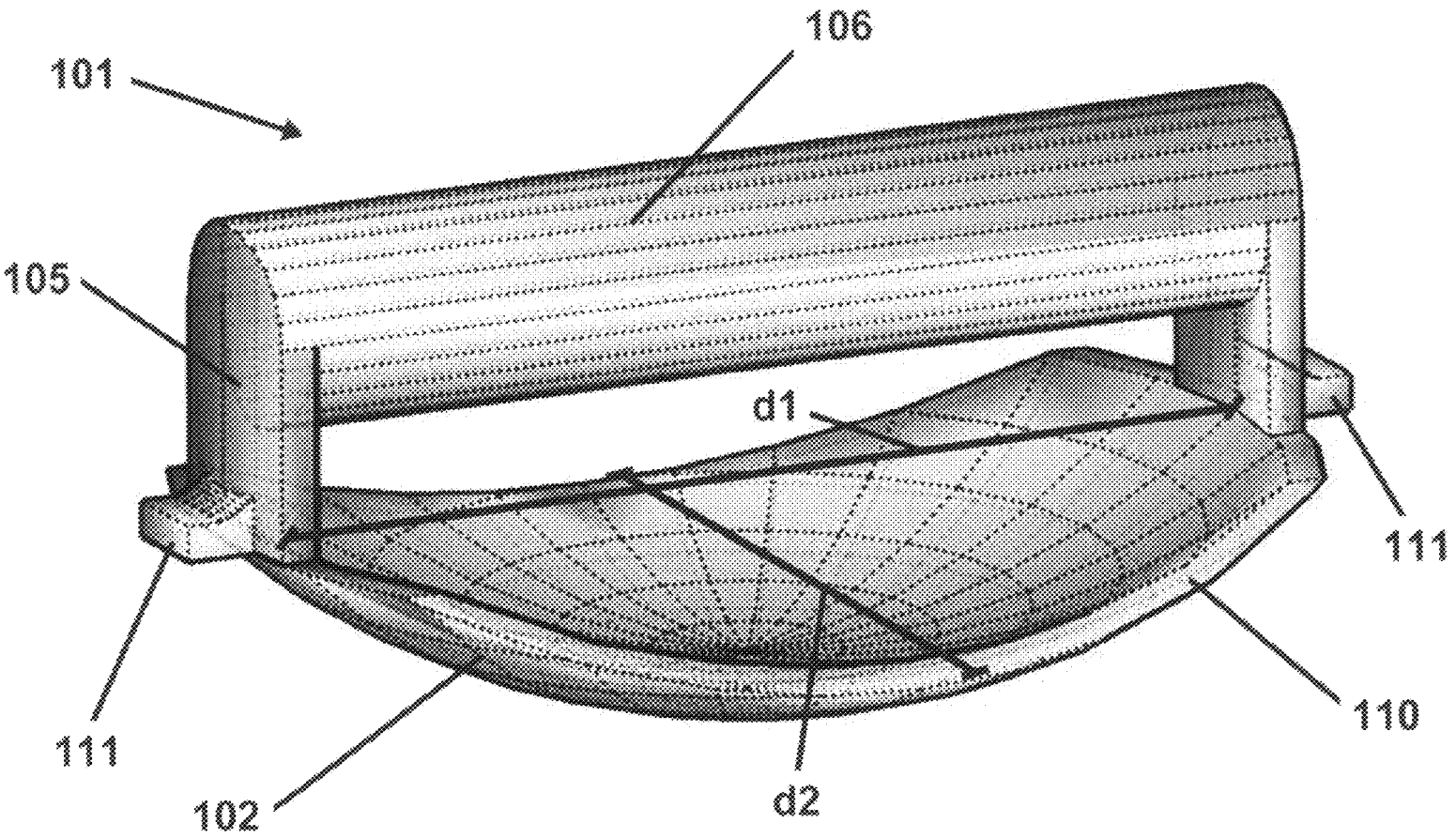
FIG. 10 shows a perspective view of an exercise apparatus according to another embodiment of the present invention.

As depicted in FIG. 5, the push-up exercise apparatus 101 may be provided generally with a base 102 which is of curved form, having a rounded or substantially convex outer surface 103 and a rounded or substantially concave inner surface 104, having a thickness (S) preferably in the range of ¼ inches to 1 inch and made from a material having high stress resistance and hardness, and low friction resistance, such as polymer (plastic), metal, wood, or similar, with polymer being preferred. The base 102 is preferably of round or circular shape as viewed from the top having a diameter (D) which may be marginally greater than the width of a clenched human hand, preferably in the range of 4 inches to 6.5 inches. However, the preferred exercise apparatus 101 may have a shape other than round or circular, as viewed from the top, to reduce unnecessary material, or to improve aesthetics. For example, as depicted in FIG. 10, the first dimension d1 of the base 102 as viewed from the top in the same axis as the handle or grasp section 106 may be longer than the second dimension d2 of the base 102 as viewed from the top in the axis perpendicular to the handle or grasp section 106. However, in one embodiment, the exercise apparatus 101 has approximately the shape of section of a sphere, as depicted in FIG. 5, or approximately the shape of a segment of an oblate ellipsoid as depicted in FIG. 10, as described below. The base 102 is preferably formed as one rigid, continuous, integrally formed structure.

A radius of curvature (R) of the base 102 will preferably allow the rounded or substantially convex outer surface 103 of the base 102 to make limited contact with the floor or other contact surface to allow for rotation about an approximately vertical axis. The radius of curvature (R) of the base 102 may vary depending on the desired intensity of the eccentricity and reaction forces desired; as the dimension of the radius of curvature (R) decreases, the eccentric forces that the body can react to also increase, and therefore provide additional exercise training. The shape of the base 102 does not necessarily have to be a section of a sphere or spherical, as described above. For example, the diameter (D) may be in the range of 4 inches to 6.5 inches. and the radius of curvature (R) may be in the range of 0.5 inches to 12 inches. As another example, the radius of curvature of an oblate ellipsoid constantly changes. The radius of curvature at the edge of the oblate ellipsoid is the smallest, and, following the curvature of the curve toward the apex (top of the curve), the radius of curvature gradually increases, until finally, at the very top of the curve, the radius of curvature is at its maximum. The radius of curvature of the base 102 may vary as described. Further, the radius of curvature of the base 102 may provide a contact area for the base 102 of less than 1 square inch with a preferable contact area being approximately ¼ square inch.

As depicted in FIG. 5, several different dimensions (e.g., thickness (S), diameter (D), radius of curvature (R) of the push-up exercise apparatus) are possible, according to the preferred embodiment. The material used for the base 102 may comprise of differently weighted material, to be interchanged to provide weight resistance for the push-up exercise apparatus 101. The rounded or substantially convex outer surface 103 of the base 102 may be smooth and provide minimal friction, allowing the ability to slide or move the apparatus when in contact with another surface. The rounded or substantially convex outer surface 103 of the base 102 may be rough and provide considerable friction, disallowing sliding or moving the apparatus when in contact with another surface.

Figure 6:
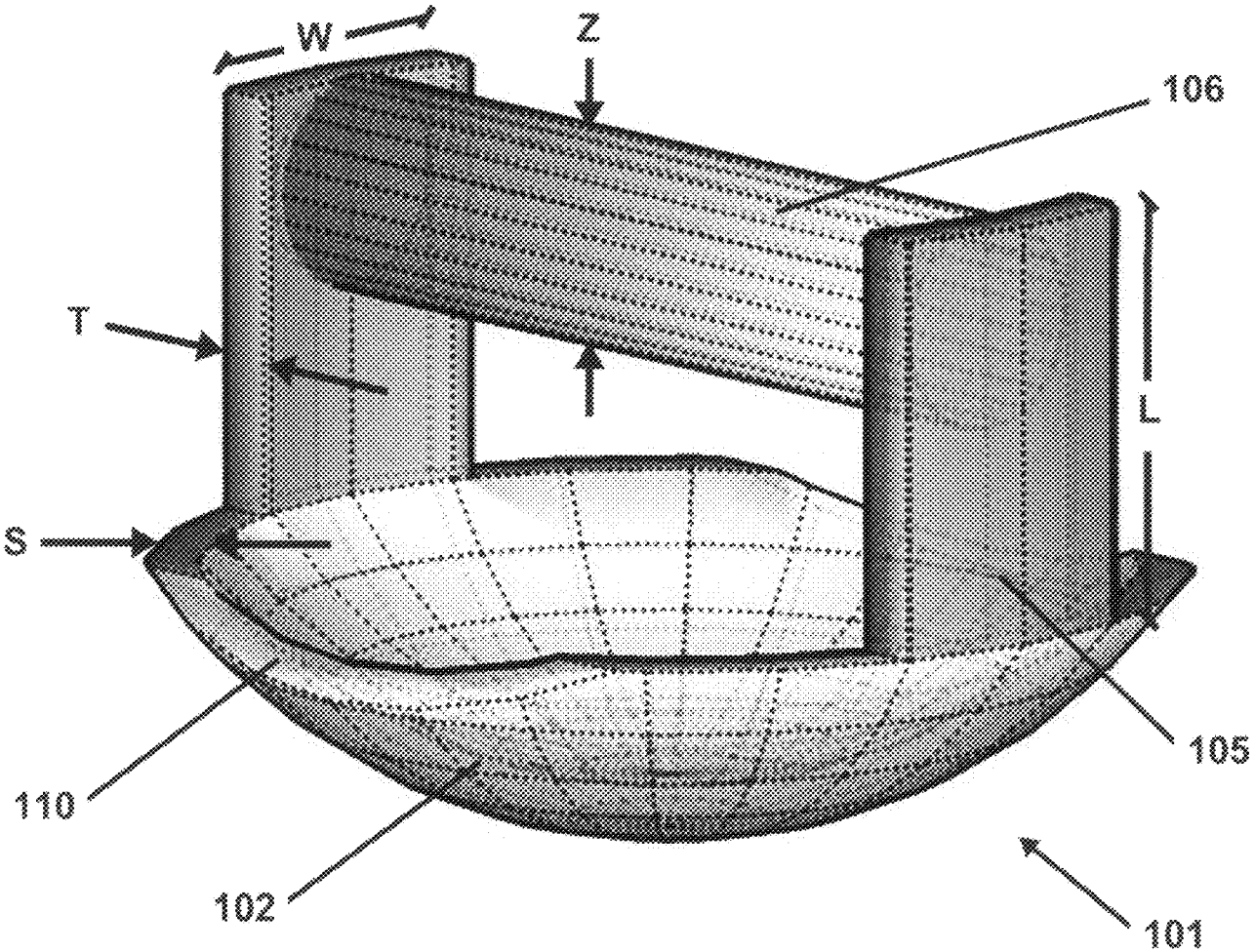
FIG. 6 shows a perspective view of an exercise apparatus according to another embodiment of the present invention.
Figure 7:
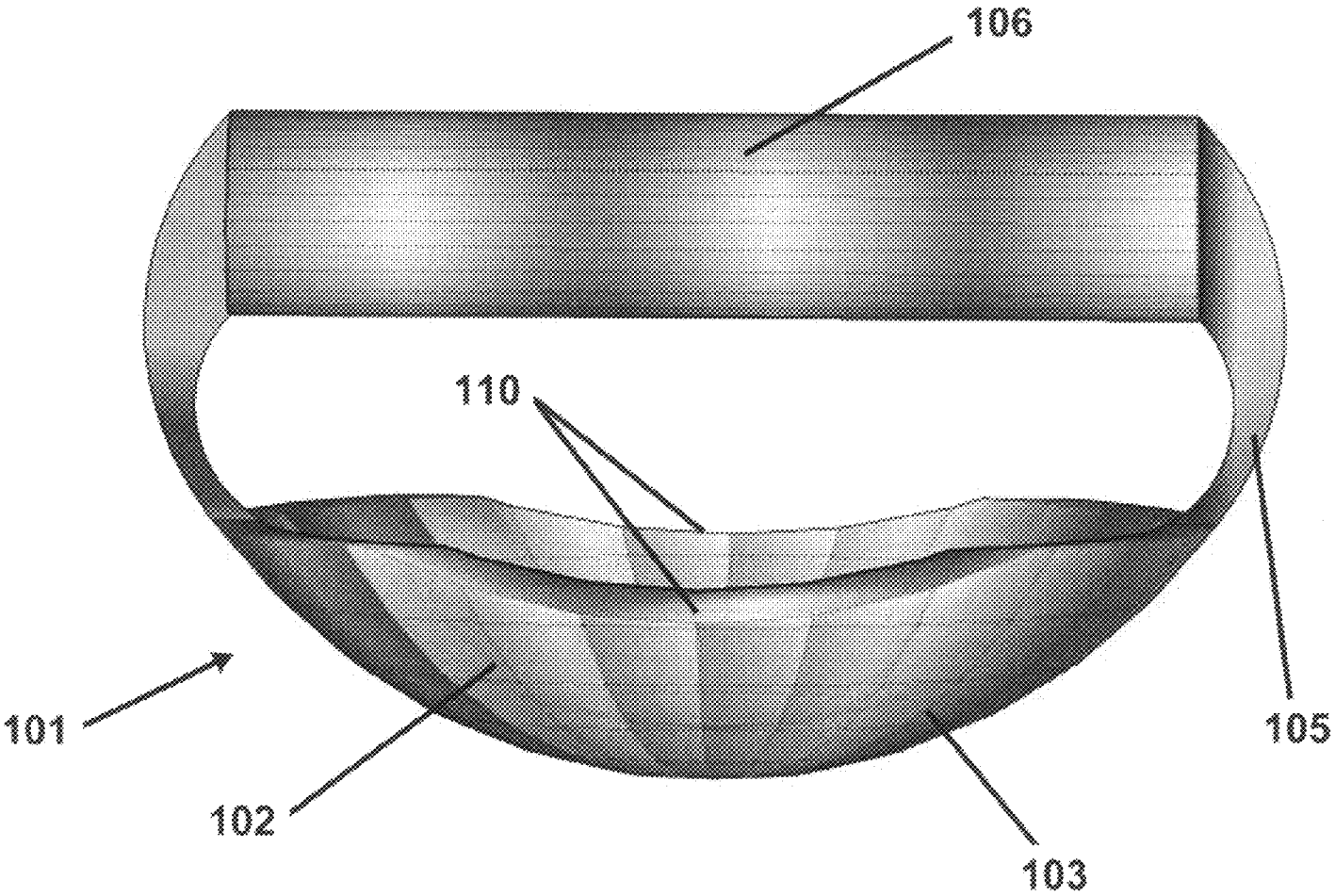
FIG. 7 shows a side view of an exercise apparatus according to another embodiment of the present invention.

As depicted in FIG. 6 and FIG. 7, perimeter edges 110 of the base 102 may be reduced to allow for efficient, compact design using minimal materials or to provide the desired aesthetics. For example, in a top view the push-up exercise apparatus 101 may have a substantially oval or elliptical shape, or it may have a shape of a circle with two portions removed that are defined by two substantially parallel chords as shown in FIG. 6 and FIG. 7.

As depicted in FIG. 6, the push-up exercise apparatus 101 may be provided generally with an extension member 105 connected to the base 102. The extension member 105 comprises at least one member connected to a perimeter of the base 102 by integrally formed molding or by one of at least another known fastening means, such a rivets, bolts, screws, and adhesive. The preferred push-up exercise apparatus 101 includes two extension members 105, which are preferably joined with the perimeter of the base 102 by means of integrally formed molding to form a rigid, continuous, integrally formed structure, as described above. The extension member 105 will preferably have a thickness (T) preferably in the range of ¼ inch to 1 inch, width (W) preferably in the range of 1 inch to 3 inches, and length (L) preferably in the range of 1 inch to 5 inches, and generally made from at least one of the same materials described with reference to the base 102, as described above. The extension member 105 thickness (T) and width (W) may vary along the length (L) of the extension member depending on desired aesthetics and necessary structural capacity. The length (L) of the extension member 105 may vary depending on the desired intensity of the eccentricity and reaction forces desired; as the dimension of the length (L) increases, the handle or grasp section 106 will be farther from the floor or contact surface, thereby increasing eccentric forces that the body can react to and therefore provide additional exercise training. As depicted in FIG. 7, the extension member 105 may be curved or shaped other than described above (e.g., with tapering thickness (T) or width (W) along the length (L)) to provide the desired aesthetics and necessary structural capacity.

As depicted in FIG. 5 and FIG. 6, the push-up exercise apparatus 101 may be provided generally with a handle or grasp section 106 (connected to the extension member 105) having an approximately cylindrical shape with an axial length (X) preferably in the range of 4 inches to 6.5 inches and diameter (Z) preferably in the range of 1 inch to 2 inches, and generally made from at least one of the same materials used for the base 102, as described above. Preferably, the handle or grasp section 106 has an axial length (X) slightly larger than the width of a human hand that is closed into a first around the handle or grasp section 106 and a diameter (Z) that provides a comfortable grip on the handle or grasp section 106 while performing a push-up exercise. The dimensions of the handle or grasp section 106 may be made larger or smaller to accommodate human hands of all sizes to allow access to the push-up exercise apparatus 101 for everyone. The handle or grasp section 106 construction may be solid or hollow along the axial length of the cylindrical shape and made of a hard, rigid, strong, durable material such as polymer (plastic), metal, wood, or similar, with a machinable material being preferred (e.g., metal). The material used for the handle or grasp section 106 may comprise differently weighted material, to be interchanged to provide weight resistance for the push-up exercise apparatus 101. The handle or grasp section 106 may be provided with a cushioned or compressible grip 109 (shown in FIG. 11) to improve the gripping surface of the handle or grasp section 106 and improve comfort during the push-up exercise and reduce point-load pressure for a human hand. The cushioned or compressible grip 109 preferably extends circumferentially around the hard cylindrical construction of the handle or grasp section 106. The cushioned or compressible grip 109 material is intended to compress and conform to human hands during the application of gripping pressure, and then expand to its original shape when gripping pressure is released. The material used for the cushioned or compressible grip 109 may comprise differently weighted material, to be interchanged to provide weight resistance for the push-up exercise apparatus 101. The handle or grasp section 106 may be at least one of cushioned, compressible, comprising ridges for the fingers, and a generally have a surface to increase contact friction for a human hand. The cushioned or compressible grip 109 may also comprise a squeezable grip, with the ability to compress by squeezing with the hands and then expand to original shape providing resistance and strength training for the hands, wrists, and forearms during the push-up exercise or independent of the push-up exercise (e.g., during running or jogging).

Figure 8:
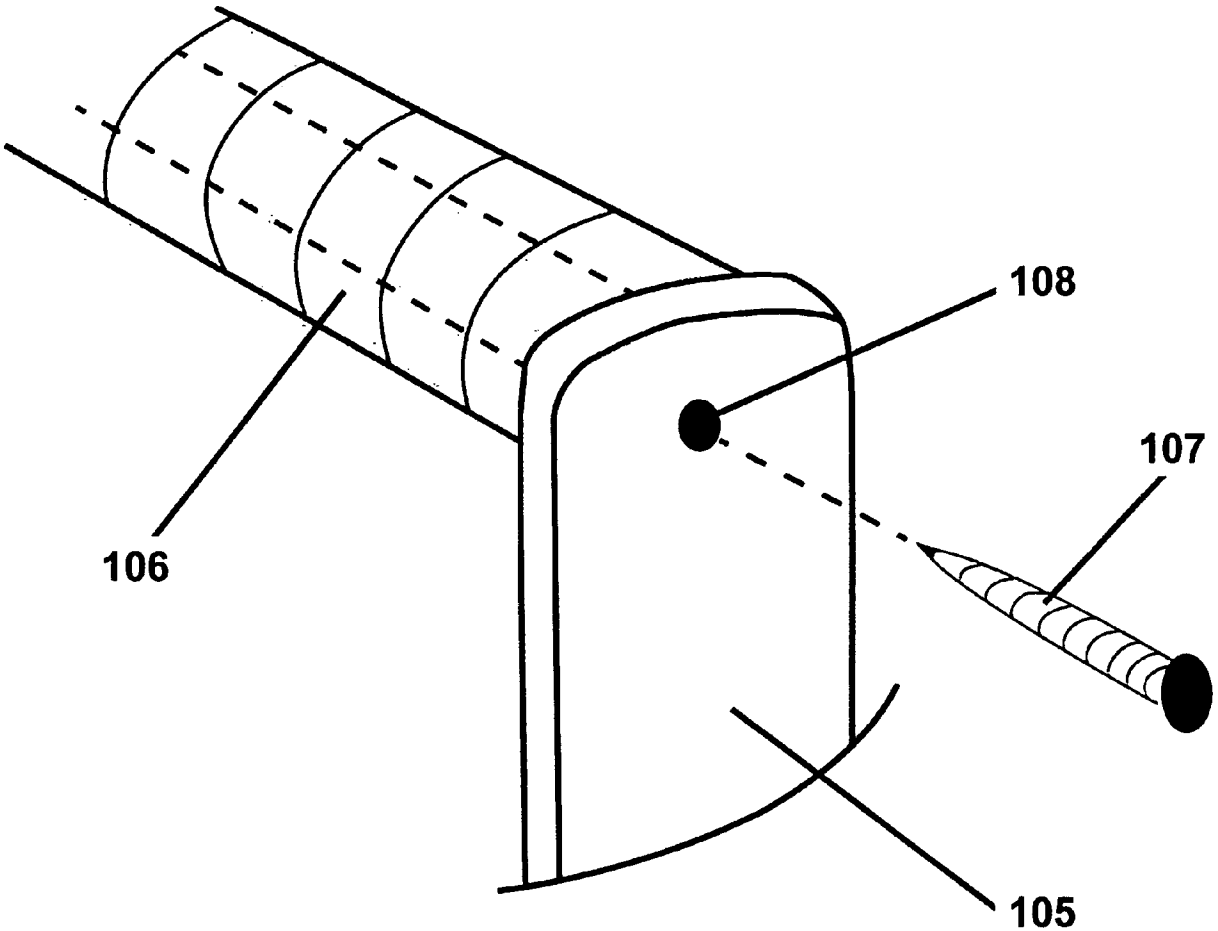
FIG. 8 shows a perspective view of a handle connection of an exercise apparatus according to another embodiment of the present invention.

As depicted in FIG. 8, one end of the extension member 105 comprises a connector for connecting the handle or grasp section 106, preferably comprising at least one removable fastener 107, to be used along with a bored and threaded receiving assembly 108, or by one of at least another known fastening means, such a rivets, bolts, screws, adhesive, and integrally formed molding. The connector will secure the handle or grasp section 106 to the extension member 105. The preferred connector used at the end of the extension member 105 where the handle or grasp section 106 is connected will allow the handle or grasp section 106 to be removable from the extension member 105 to be at least one of disassembled and replaced, without permanently altering the push-up exercise apparatus 101. The bored and threaded receiving assembly 108 may extend axially into each end of the handle or grasp section 106.

Figure 9:
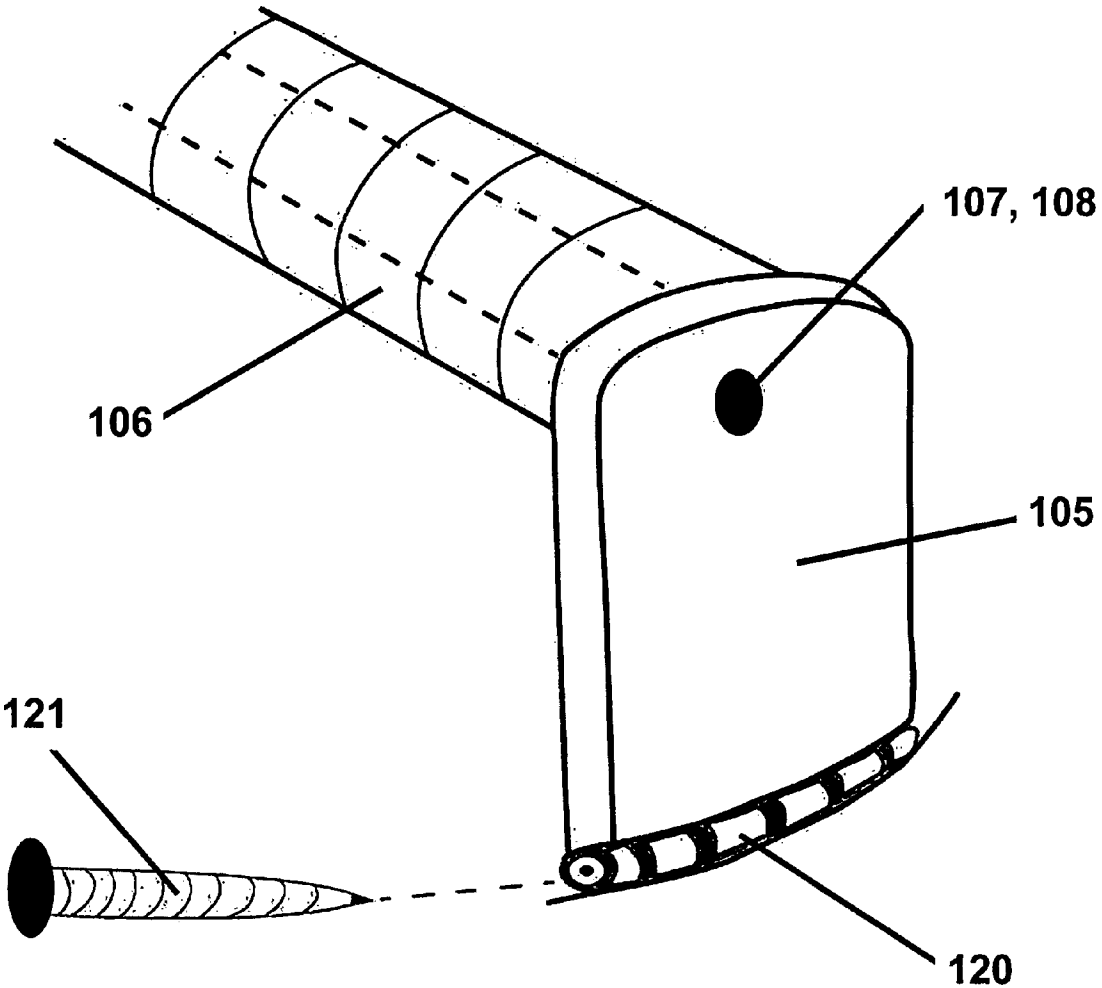
FIG. 9 shows a perspective view of a handle connection of an exercise apparatus according to another embodiment of the present invention.

As depicted in FIG. 9, a connection of the extension member 105 may be configured in many different forms, such as collapsible, hinged, or fixed, and may include removable parts for more convenient storage or providing supplementary replacement parts, and providing necessary structural capacity. For example, FIG. 9 shows a connector comprising a hinge 120 including a pin 121.

Figure 11:
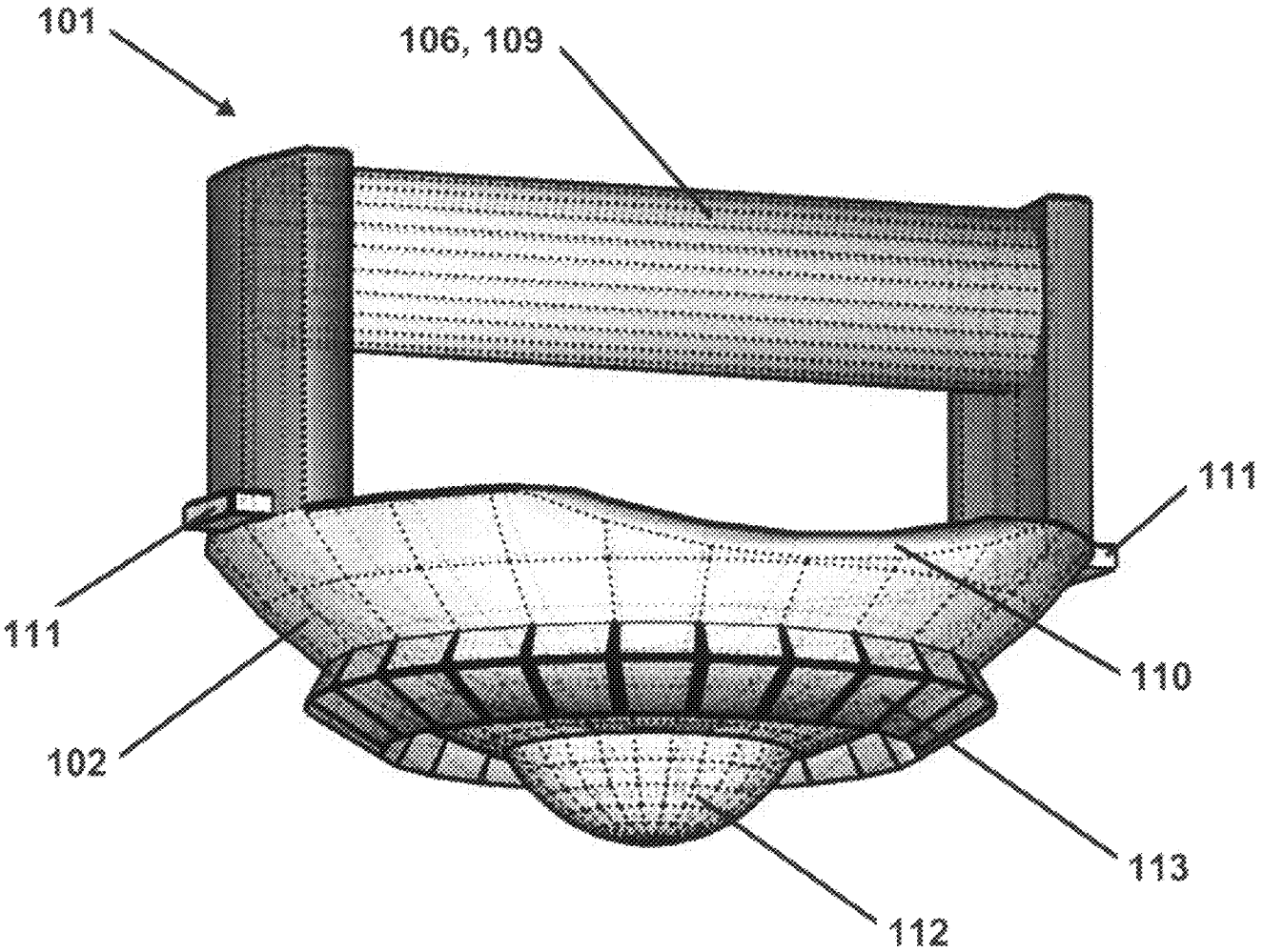
FIG. 11 shows a perspective view of an exercise apparatus according to another embodiment of the present invention.

As depicted in FIG. 10 and FIG. 11, a small fixed extension piece 111 may be provided at an outer surface of the extension member 105 or the base 102, which can be used in association with another exercise apparatus such as a pull-up embodiment, to support the weight of the body during a pull-up exercise, and providing necessary structural capacity. For example, a pull-up embodiment secured at the top of a doorframe may include at least one of slots, grooves, notches, raceway, to allow the extension pieces 111 of the push-up exercise apparatus 101 to mate with the pull-up embodiment and doorframe to enable performing a pull-up exercise. For example, the pull-up embodiment may comprise a grooved raceway set in a horizontal plane with two notches to allow the extension pieces 111 of the push-up exercise apparatus 101 to enter the raceway and become locked into the raceway when the push-up exercise apparatus 101 is rotated within the raceway of the pull-up embodiment.

As depicted in FIG. 11, additional material, which is of curved form, having a rounded or substantially convex surface 112 may be added to the underside of the base 102, with a smaller radius of curvature (i.e., higher curvature) than that of the rounded or substantially convex outer surface 103 to provide additional instability, and provide a more intense push-up exercise. The additional material having a rounded or substantially convex surface 112 may be connected to the underside of the base 102 by integrally formed molding or by one of at least another known fastening means, such a rivets, bolts, screws, and adhesive.

As depicted in FIG. 11, a ring of additional material 113 may be connected to the underside of the base 102 by integrally formed molding or by one of at least another known fastening means, such a rivets, bolts, screws, and adhesive. The ring of additional material 113 may be formed as one rigid, continuous, integrally formed structure, affixed to the underside of the base 102 to provide supplementary stability for the push-up exercise apparatus 101 after a predetermined limit of motion is reached; for example, after the push-up exercise apparatus 101 moves away from the vertical axis more than between 10 and 30 degrees (such as 20 degrees), the ring of additional material 113 touches the same contact surface as the base 102 of the push-up exercise apparatus 101, thereby providing stability and limiting the push-up exercise apparatus 101 from tilting away from the vertical axis more than 20 degrees. For example, the general range the ring of additional material 113 may allow the push-up exercise apparatus 101 to tilt away from the vertical axis may be between 5 degrees and 70 degrees.

Figure 12:
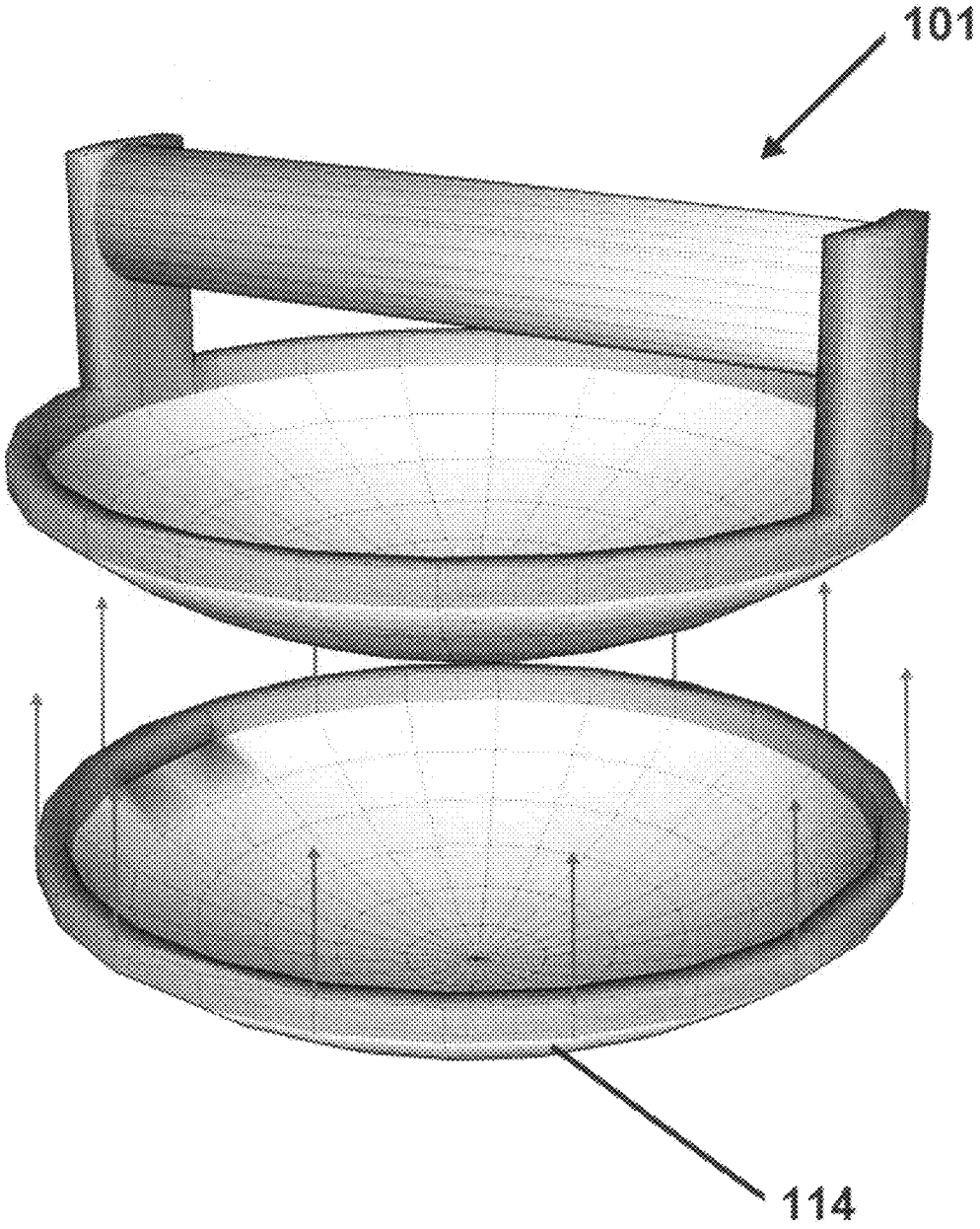
FIG. 12 shows a perspective view of an exercise apparatus according to another embodiment of the present invention.

As depicted in FIG. 12, a replaceable base attachment piece 114 may be provided for the push-up exercise apparatus 101 for use outdoors or on rough surfaces that may wear down the base 102. The replaceable attachment piece 114 may be mechanically attached, adhesively attached, or attached by any other means known, such as Velcro™ to offer a solution for replacement of a worn outer surface. The replaceable base attachment piece 114 may comprise of differently weighted material, to be interchanged to provide weight resistance for the push-up exercise apparatus 101.

It will be apparent to the skilled artisan that there are numerous changes that may be made in embodiments described herein without departing from the scope and spirit of the present invention. While the principles of the invention have been described above in connection with specific novel embodiments and claims, it is to be understood that this description is made only by way of example, and not as a limitation on the scope of the invention, it is not intended to be limited to the description above, since it will be understood that various modifications, including possible omissions, substitutions, and changes in the specifications of the push-up exercise apparatus 101 illustrated and the preferred methods can be made by those skilled in the art without departing in any way from the spirit of the present invention. For example, the various dimensions discussed may differ. In another example, the method for the push-up exercise apparatus 101 may differ, such as, but not limited to, using the push-up exercise apparatus 101 with another piece of equipment, such as martial arts training, or for protecting the hands during combat. As such, the invention qualified herein by specific examples is limited only by the scope of the claims that follow:

What is claimed is:

1. An exercise apparatus comprising:

a continuous wall forming a curved form base comprising, an outer surface, continuously convex at all points, formed on a first side of said continuous wall, an exposed concave inner surface, formed on a second side of said continuous wall, and two extension members extending vertically from two opposing perimeter edges of said curved form base and integrally formed thereupon, wherein said curved form base has a curved shape selected from a group of curved shapes comprising a substantially semi-spherical shape, a substantially oblate ellipsoid shape, a substantially oval shape, a substantially elliptical shape, or a substantially curved shape, wherein each of said two extension members are configured with a handle connector; and a handle adapted to be connected to said two extension members at said handle connector on each of said two extension members, wherein said handle is comprised of a grasp section configured to be gripped by a hand of a user.

2. The exercise apparatus as claimed in claim 1, wherein the apparatus comprises a convex outer surface that is at least one of:

a) smooth; and b) rough.

3. The exercise apparatus as claimed in claim 1, wherein the handle comprises at least one of:

a) a rigid handle that is integrally formed with the two extension members; and b) a rigid handle that is mechanically fastened to each of the two extension members.

4. The exercise apparatus as claimed in claim 1, wherein the grasp section of the handle has at least one of the following features:

a) the grasp section comprises ridges for human fingers;

b) the grasp section is at least one of curved, profiled, and contoured;

c) the grasp section comprises a rough surface to increase contact friction for the human hand;

d) the grasp section comprises a squeezable grip to provide exercise; and e) the grasp section comprises a compressible material to reduce point-load pressure for the human hand.

5. The exercise apparatus as claimed in claim 1, wherein at least one of the handle and the extension member comprises at least one of a removable fastener, hinge, and removable part, and is adapted to be at least one of:

a) removable; and b) collapsible.

6. The exercise apparatus as claimed in claim 1, wherein the exercise apparatus comprises an interchangeable handle weighting between 0.25 lbs and 25 lbs to provide additional strength training during an exercise.

7. The exercise apparatus as claimed in claim 1, wherein the curved form base of the exercise apparatus is adapted to have a replaceable outer surface that is detachably connected to the curved form base and configured so that at least one of the following is true:

a) the replaceable outer surface is mechanically attached to the convex outer surface of the curved form base;

b) the replaceable outer surface is adhered to the convex outer surface of the curved form base; and c) the replaceable outer surface comprises a range of weights to provide additional strength training during an exercise.

8. The exercise apparatus as claimed in claim 1, wherein the convex outer surface of the curved form base contains additional material having a radius of curvature less than a radius of curvature of the convex outer surface, configured to provide further instability during a push-up exercise.

9. The exercise apparatus as claimed in claim 8, further comprising a ring of material encircling the additional material and protruding from the curved form base, so as to prevent further instability once a certain threshold of instability is reached.

10. The exercise apparatus as claimed in claim 1, wherein the curved form base comprises extension members configured to connect to a pull-up apparatus for other exercises.

11. The apparatus as claimed in claim 1, wherein the convex outer surface has a radius of curvature of between approximately 0.5 inches and 12 inches.

12. The apparatus as claimed in claim 1, wherein the curved form base along a same axis as the handle has a dimension of between approximately 4 inches and 6.5 inches.

13. The apparatus as claimed in claim 1, wherein the curved form base along an axis perpendicular to the handle has a dimension of between approximately 2 inches and 6.5 inches.

14. The apparatus as claimed in claim 1, wherein the curved form base has a substantially uniform thickness of between approximately ¼ inch and 1 inch.

15. The apparatus as claimed in claim 1, wherein the curved form base has a cross sectional shape having two substantially parallel sides and two rounded edges.

16. The apparatus as claimed in claim 1, wherein each of said two vertical extension members is a flange that i) is formed continuously with said continuous wall and ii) extends beyond a rim defining the top of the perimeter edges of said curved form base.

17. The apparatus as claimed in claim 16, wherein each of said two vertical extension members is a flange that has substantially the same thickness as said continuous wall.

18. The apparatus as claimed in claim 16, wherein said two vertical extension members are parallel and connected by a rigid handle forming a substantially inflexible connection between said handle connectors of each of said two extension members.

19. The apparatus as claimed in claim 17, wherein the bottom of said rigid handle and said concave surface of said curved form base define an opening for a hand of a user.

20. An exercise apparatus comprising:

a continuous wall forming a curved form base comprising, a outer surface, continuously convex at all points, and an exposed concave inner surface, wherein said curved form base has a curved shape selected from a group of curved shapes comprising a substantially semi-spherical shape, a substantially oblate ellipsoid shape, a substantially oval shape, a substantially elliptical shape, or a substantially curved shape; and two extension members extending vertically from two opposing perimeter edges of said curved form base, wherein each of said two extension members are configured to be connected by a handle.

21. The exercise apparatus as claimed in claim 1, wherein said curved form base has a weight of between 0.25 lbs and 25 lbs to provide additional strength training during an exercise.

* * * * *